United States Patent [19]

Hoffmann

[11] 4,354,221

[45] Oct. 12, 1982

[54] GUIDANCE LIGHT FOR AIRPORT RUNWAYS

[75] Inventor: Marcel E. Hoffmann, Lasne, Belgium

[73] Assignee: Societe Anonyme des Establissements Adrien de Backer, Brussels, Belgium

[21] Appl. No.: 204,873

[22] Filed: Nov. 7, 1980

[51] Int. Cl.[3] ..... F21V 7/00

[52] U.S. Cl. ..... 362/300; 362/301; 362/347; 362/350

[58] Field of Search ..... 340/26; 362/341, 347, 362/346, 298, 301, 300, 350

[56] References Cited

U.S. PATENT DOCUMENTS 3,279,406 10/1966 Ricketts ..... 340/26

3,999,054 12/1976 Dorman ..... 340/26

*Primary Examiner*—Donald P. Walsh

*Attorney, Agent, or Firm*—Fitzpatrick, Cella, Harper & Scinto

[57] ABSTRACT

A guidance light including an optical system comprising a reflector having an internal concave reflecting surface formed as a surface of revolution about the optical axis. Said reflecting surface is configured so as to reflect the light from a light source onto said axis along a continuous segment thereof such that each point reflects light onto said segment at a distance from its end nearest to the light source which is proportional to the arcuate length of the reflecting surface between said point and the intersection of said surface and said axis. Exit optical means are also included to redirect the light beam in the suitable direction.

6 Claims, 2 Drawing Figures

GUIDANCE LIGHT FOR AIRPORT RUNWAYS

BACKGROUND OF THE INVENTION

The present invention relates to a guidance light for guiding aircrafts on airport runways and particularly to a simple and improved light reflector for such a guidance light.

A known guidance light is disclosed in U.S. Pat. No. 3,678,260 issued to Edward W. Beal. This apparatus includes a light reflector comprised of elliptical surface portions which reflect the light rays to conjugate focus points. The reflector in this known apparatus is designed to capture a greater part to the light produced by the source so as to reinforce the intensity of the light beam.

However, a major problem in designing aircraft guidance light for airport runways is still to provide an optical system which produces a light beam having a quasi-uniform distribution of light intensity across the entire beam while capturing the maximum light produced by the light source, thereby to provide the most efficient conditions for approach, landing and take-off purposes.

SUMMARY OF THE INVENTION

An object of this invention is to provide an aircraft guidance light having an optimum light output.

Another object of the invention is to provide an aircraft guidance light which includes a simple and improved light reflector system especially designed to produce a quasi-uniform light beam throughout.

Yet another object of this invention is to provide a useful aircraft guidance light for being embedded in a runway while providing a quasi-uniform and optimum light beam through a vertical exit window aperture.

In accordance with the invention, a guidance light includes a reflector having an internal concave reflecting surface facing the light source, which is formed as a surface of revolution about the optical axis and which is configured so as to reflect light from said source onto said axis along a continuous segment thereof such that each point reflects light onto said segment at a distance from its end nearest to the light source which is proportional to the arcuate length of the reflecting surface between said point and the intersection of said surface and said axis.

BRIEF DESCRIPTION OF THE DRAWINGS

An exemplary embodiment of the invention is shown in the accompanying drawings in which.

DESCRIPTION OF AN EXEMPLARY EMBODIMENT

Figure 1:
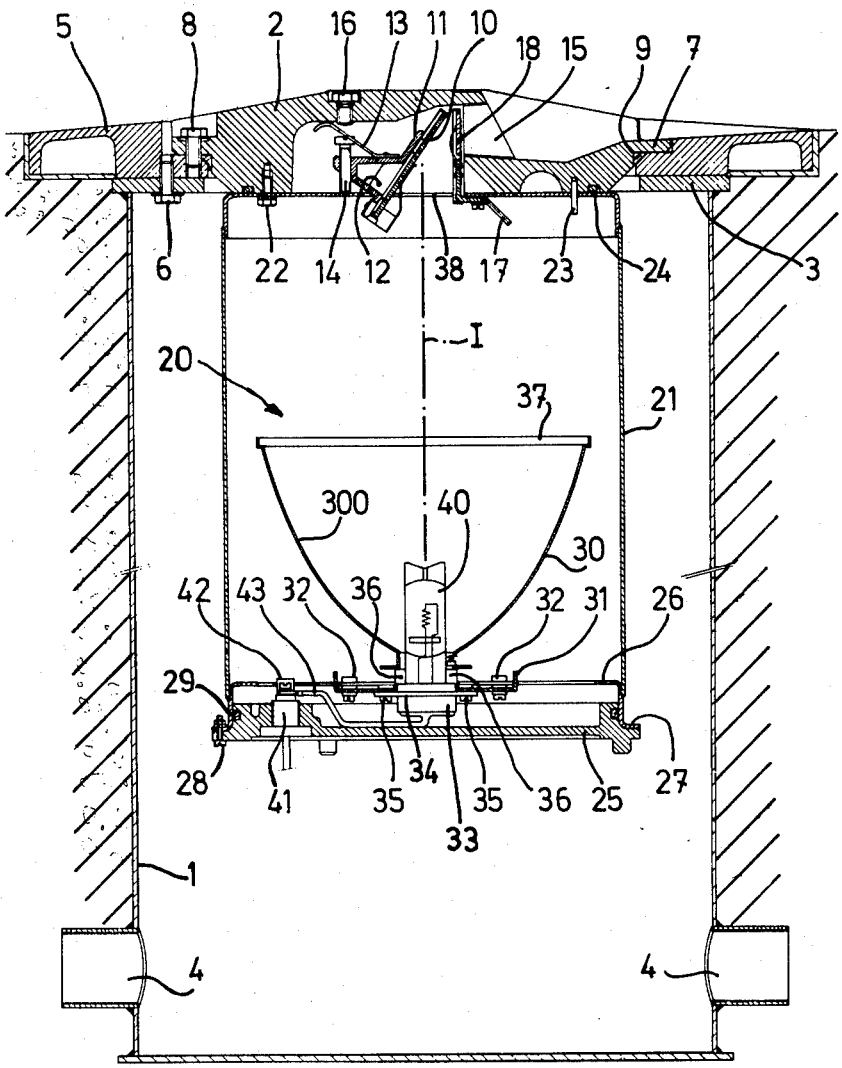
FIG. 1 is a cross-sectional view of a guidance light in accordance with the invention.

Referring to FIG. 1 there is shown a guidance light comprising a housing 1 to be embedded in the runway and provided at one end with a removable cover 2 to the underside of which is secured the optical system.

The housing 1 has an annular flange 3 for mounting the housing embedded in the runway and ports 4 for the passage of the power feed cable. A support ring 5 is secured to the annular flange 3 by bolts 6, said ring 5 supporting the removable cover 2. The latter has a peripheral flange 7 for fixedly mounting the cover on the support ring 5 by means of bolts 8. The numeral 9 denotes a seal ring. When embedded in the runway, the housing 1 has its outward upper edge at grade level with the runway.

The cover 2 has an aperture fitted with a prism 15 for passage of the output light beam from the suspended optical system.

The optical system comprises a light assembly 20 and a mirror 10. The light assembly 20 is comprised of a casing 21, preferably of cylindrical shape, which is secured at its upper end to the cover 2 by bolts 21.

The numeral 23 denotes a positioning pin. A seal ring 24 is provided in the underside of cover 2 to assure hermetical sealing between said cover and the casing 21. The latter houses a light source 40 with a reflector 30. The casing 21 is provided with an inner flange 26 for securing a mounting plate 31, of rectangular shape, by means of four screwed silent blocks 32 in order to prevent vibration to be transmitted to the light source and light reflector. The mounting plate 31 has a central aperture for insertion of a lamp support 33 having lugs 34 for being fixed to the plate 31 by screws 35. The reflector 30 is mounted to the mounting plate 31 by means of four support pieces 36 with its optical axis I extending lengthwise the casing 21. The reflector has a central opening for allowing passage of the lamp 40 and it has its outer edge strengthened by a stiffening rib 37.

The casing 21 is closed at its lower end by a base 25 made for instance of aluminum, which is fixed to the outer flange 27 by means of screws 28 Hermeticity is assured by a seal ring 29. The base has a feed-through 41 for the passage of the power cable, said feed-through having a terminal 42 for connection of the insulated feed conductor 43 to the lamp 40.

The upper end of the casing 21 is formed with a central opening 38 for passage of the light beam from reflector 30 to the mirror 10.

Figure 2:
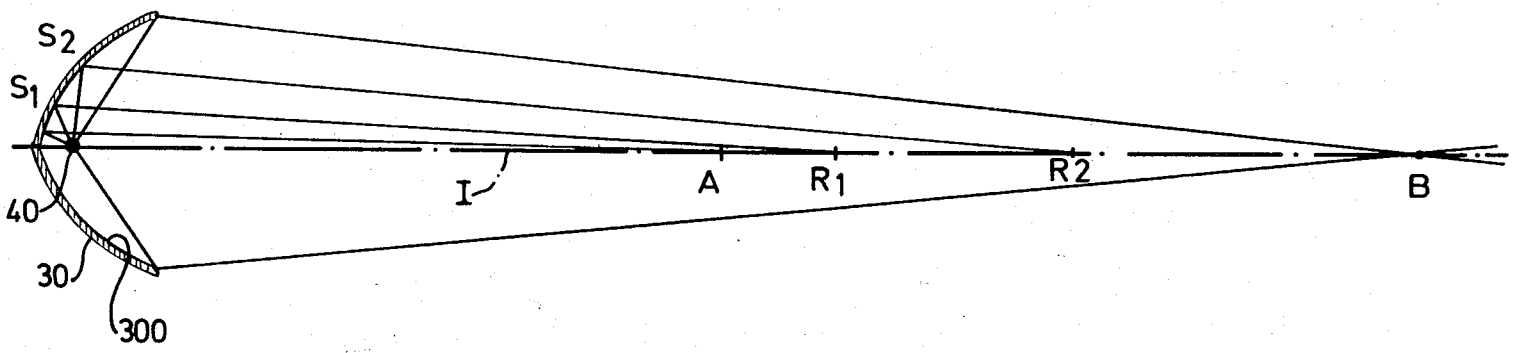
FIG. 2 is a schematic diagram illustrating the reflector design in accordance with the invention.

The reflector 30 is designed as illustrated in FIG. 2. The reflector has an internal concave reflecting surface 300 facing the light source, which is formed as a surface of revolution about the axis I. The reflecting surface 300 is configured to uniformly reflect light from source 40 onto axis I along a segment AB thereof. Letter A denotes the nearest end of said segment, that is the point of intersection of light reflected from the reflecting surface 300 nearest the opening for the lamp 40.

Any point on surface 300, e.g. point $s_1$ reflects light onto said segment AB on axis I at an angle not exceeding approximately fifteen degrees. Any two points of intersection of light on segment AB are at a distance d from each other which is related, as a continuous function, to the arcuate length 1 of the surface 300 between the corresponding reflecting points. Considering for instance the reflecting points $s_1$ and $s_2$ on surface 300 in a plane containing the axis I, the reflected light intersects segment AB at points $R_1$ and $R_2$. In accordance with this invention, the distance $R_1-R_2$ is a direct function of, viz. proportional to the arcuate length $s_1-s_2$. This relation can be expressed by:

$$d=k\cdot l$$

where d is the distance along segment AB k is a constant l is the arcuate length on the reflecting surface.

With this configuration the reflector according to the invention is capable of transmitting the maximum light energy within the useful cone in the axial direction, thereby substantially increasing the light output efficiency of the system.

The reflected light beam from reflector 30 strikes the mirror 10 disposed at an angle to the axis I to intercept the light beam from the reflector 30 between the points A and B and to redirect the light beam through the prism 15 as a uniform beam having an axial direction inclined at a small angle to the horizontal. The mirror 10 is mounted to a mirror support 11 which is pivotable about a horizontal pivot 12 secured to the cover. A spring 13 is connected between the mirror support 11 and the cover 2 with the effect of urging the mirror support 11 upwardly. An adjustable control screw 14 keeps the mirror support 11 in the correct position. The cover 2 is provided with a screw-plug 16 which, when removed, allows easy access to the control screw 14 for adjusting the position of the mirror 10 with respect to the prism 15. A filter support 17 is also secured to the casing 21 for positioning a suitable filter 18 (dispersing filter or color filter) in front of the exit prism 15.

In a variation to the construction as illustrated, the mirror 10 and the exit prism 15 may be replaced by a unique total reflection prism mounted so as to be hermetically sealed in the aperture of cover 2 with a reflecting face inclined at an angle to the optical axis I, thereby to combine both the functions of said mirror 10 and said exit prism 15.

I claim:

1. A guidance light for airport runway comprising a casing in which are mounted a light source and an optical system to direct light along a path which includes a given axis, said optical system including a reflector having an internal concave reflecting surface facing said light source and being formed as a surface of revolution about said axis, said reflecting surface being configured so as to reflect light from said source onto said axis along a continuous segment thereof such that each point reflects light onto said segment at a distance from its end nearest to the light source which is proportional to the arcuate length of the reflecting surface between said point and the intersection of said surface and said axis.

2. A guidance light according to claim 1, wherein the reflector is supported by a mounting plate which is elastically fixed to the casing.

3. A guidance light according to either of claims 1 and 2, wherein the optical system further includes optical means to intercept the light beam from said reflector to redirect it a light beam having an axial direction inclined at a small angle to the horizontal, said optical means consisting of a mirror placed at an angle to the optical axis of the reflector, said mirror being fixed to an adjustable mounting means mounted to the casing.

4. A guidance light according to claim 3, wherein the adjustable mounting means for said mirror comprises mirror support means pivotably fixed to the casing, said support means having an adjustable screw for adjusting the position of the mirror.

5. A guidance light according to claim 4, wherein the casing is closed by a cover, said cover having an opening fitted with a removable plug which, when removed, provides easy access to the adjustable screw for said mirror support means.

6. The guidance light according to either of claims 1 and 2, wherein the optical system further includes optical means to redirect the light beam from said reflector as a light beam having an axial direction inclined at a small angle to the horizontal, said optical means consisting of a total reflection prism hermetically sealed in the aperture of the cover and having a reflecting face inclined at an angle to the optical axis of the reflector.

* * * * *